US011534698B1

(12) United States Patent
You et al.

(10) Patent No.: US 11,534,698 B1
(45) Date of Patent: Dec. 27, 2022

(54) LUMINOUS BALLOON

(71) Applicant: Yiwu Locyop Household Product co., Ltd., Zhejiang (CN)

(72) Inventors: Wenbiao You, Zhejiang (CN); Changwei Long, Zhejiang (CN)

(73) Assignee: Yiwu Locyop Household Product co., Ltd., Yiwu (CN)

( * ) Notice: Subject to any disclaimer, the term of this patent is extended or adjusted under 35 U.S.C. 154(b) by 0 days.

(21) Appl. No.: 17/577,246

(22) Filed: Jan. 17, 2022

(30) Foreign Application Priority Data

Nov. 30, 2021 (CN) ..... 202111442200.9

(51) Int. Cl.

| | |
|---|---|
| ***A63H 27/10*** | (2006.01) |
| ***F21V 23/06*** | (2006.01) |
| ***F21V 23/04*** | (2006.01) |
| ***F21V 23/00*** | (2015.01) |
| ***F21W 121/00*** | (2006.01) |

(52) U.S. Cl.
CPC ..... *A63H 27/10* (2013.01); *F21V 23/003* (2013.01); *F21V 23/04* (2013.01); *F21V 23/06* (2013.01); *A63H 2027/1058* (2013.01); *F21W 2121/00* (2013.01)

(58) Field of Classification Search
CPC ..... A63H 27/10; F21V 23/003; F21V 23/04; F21V 23/06
See application file for complete search history.

(56) References Cited

U.S. PATENT DOCUMENTS

| | | | | |
|---|---|---|---|---|
| 10,704,761 | B1 * | 7/2020 | Zhu | A63H 27/10 |
| 2006/0141898 | A1 * | 6/2006 | Retell | A63H 27/10 446/220 |
| 2006/0291217 | A1 * | 12/2006 | Vanderschuit | A63H 33/22 362/363 |
| 2008/0032588 | A1 * | 2/2008 | Sun | G09F 21/10 362/565 |
| 2008/0032589 | A1 * | 2/2008 | Sun | G09F 21/10 362/565 |
| 2008/0032590 | A1 * | 2/2008 | Sun | A63H 27/10 362/565 |
| 2017/0118822 | A1 * | 4/2017 | Kosted | A63H 27/10 |
| 2017/0293060 | A1 * | 10/2017 | Hayashi | A63H 27/10 |
| 2019/0030447 | A1 * | 1/2019 | Zima | B64D 47/08 |
| 2021/0113935 | A1 * | 4/2021 | Zima | B64B 1/40 |
| 2022/0349550 | * | 11/2022 | Mitchell | A63H 27/10 |

* cited by examiner

*Primary Examiner* — Bryon T Gyllstrom
(74) *Attorney, Agent, or Firm* — Dragon Sun Law Firm, PC; Jinggao Li; Nathaniel Perkins

(57) ABSTRACT

The present invention provides a luminous balloon, including a balloon, a connection piece and a light-emitting assembly. The balloon has an inflation opening and a connection opening. The connection piece is fixed at the connection opening and connected with the light-emitting assembly. The light-emitting assembly includes a controller and a light-emitting lamp, the controller is exposed outside the balloon, and the light-emitting lamp passes through the connection piece to wholly or partially protrude into the balloon. In this design, the luminous balloon has an independent inflation opening, the controller exposed outside the balloon controls the light-emitting lamp, and the light-emitting lamp protrudes into the balloon to entirely illuminate the balloon or an irregularly-shaped balloon, thus achieving good decorative effect.

10 Claims, 8 Drawing Sheets

LUMINOUS BALLOON

CROSS-REFERENCE TO RELATED APPLICATION

The present application is based on, and claims priority from, Chinese application number 202111442200.9, filed Nov. 30, 2021, closure of which is hereby incorporated by reference herein in its entirety.

TECHNICAL FIELD

The present invention relates to a luminous balloon.

BACKGROUND

In the prior art, the luminous balloons are divided into three types. In one type, a lamp wire is wound around a surface of the balloon, but the lamp wire may easily fall off. In another type, a lamp wire is bound to the top of the balloon or a small lamp is placed inside the balloon. However, when the balloon is blown up, dimming cannot be performed using a switch. Therefore, when such balloons are used for decoration or at a meeting site, the balloons may use up power until evening, resulting in very low brightness. ISn the last type, a lamp wire is bound to an inflation opening, bringing inconvenience to inflation. Further, when the balloon is not completely filled, brightness is mainly concentrated at the inflation opening, producing an undesirable effect.

SUMMARY

In order to solve the above defects of the prior art, the object of the present invention is to provide a luminous balloon.

A technical solution of the present invention is described as follows: there is provided a luminous balloon, comprising a balloon, wherein the luminous balloon further comprises a connection piece and a light-emitting assembly, the balloon has an inflation opening and a connection opening, the connection piece is fixed at the connection opening and connected with the light-emitting assembly, the light-emitting assembly comprises a controller and a light-emitting lamp, the controller is exposed outside the balloon, and the light-emitting lamp passes through the connection piece to wholly or partially protrude into the balloon.

Furthermore, the inflation opening and the connection opening are located on a bottom end and a top end of the balloon respectively.

Furthermore, the connection piece comprises a pressing nut and a pressing plug, the pressing nut is abutted against an inner wall of the balloon, and the pressing plug is pressed on an outer wall of the balloon.

Furthermore, the controller comprises an upper cover and a lower cover, a lower end of the lower cover has a screw rod extending up and down, the lower cover is pressed on the top of the pressing plug, and the screw rod is passed through the pressing plug and then screwed down into the pressing nut.

Furthermore, the lower cover has a first through hole penetrating up and down, the pressing plug has a second through hole for the screw rod to pass through, and the pressing nut has a thread hole penetrating up and down and mating with the screw rod.

Furthermore, the controller further comprises a control board, a battery, a switch and an infrared receiver; the control board, the battery and the infrared receiver are mounted inside the lower cover, and an outer end of the switch extends out of the lower cover.

Furthermore, there are a plurality of batteries, an insulating sheet is fitted between two batteries and an upper end of the insulating sheet extends out of the upper cover.

Furthermore, the upper cover and the lower are connected by a fastener.

Furthermore, an upper end of the upper cover has a hook.

Furthermore, the controller further comprises a USB connector which is connected to the light-emitting lamp through a lamp wire.

The application of the luminous balloon of the present invention brings the following beneficial effects: the luminous balloon has an independent inflation opening, the controller exposed outside the balloon controls the light-emitting lamp, and the light-emitting lamp protrudes into the balloon to illuminate the entire balloon, thus achieving a desirable decorative effect.

BRIEF DESCRIPTIONS OF THE DRAWINGS

Numerals of the drawings are described below: 1. balloon, 1.1 inflation opening, 1.2 connection opening, 3.1 thread hole, 4 pressing plug, 4.1 a second through hole, 5 upper cover, 5.1 fastening hole, 5.2 hook, 6 lower cover, 6.1 screw rod, 6.2 first through hole, 6.3 fastener, 7 control board, 8 battery, 9 switch, 10 infrared receiver, 11 insulating sheet, 12 USB connector, and 13 lamp wire.

DETAILED DESCRIPTIONS OF EMBODIMENTS

In order to visually and fully understand the technical solution of the present invention, non-limiting descriptions are made below to the features of the present invention in combination with accompanying drawings of the present invention.

In an embodiment 1, as shown in FIGS. 1-6, provided is a luminous balloon. The luminous balloon includes a balloon 1 and further includes a connection piece and a light-emitting assembly. The balloon 1 has an inflation opening 1.1 and a connection opening 1.2, and the inflation opening 1.1 and the connection opening 1.2 are located on a bottom end and a top end of the balloon 1, respectively. The connection piece is fixed at the connection opening 1.2 and connected with the light-emitting assembly. The light-emitting assembly includes a controller and a light-emitting lamp 2, the controller is exposed outside the balloon 1, and the light-emitting lamp 2 passes through the connection piece to wholly or partially protrude into the balloon 1.

Figure 1:
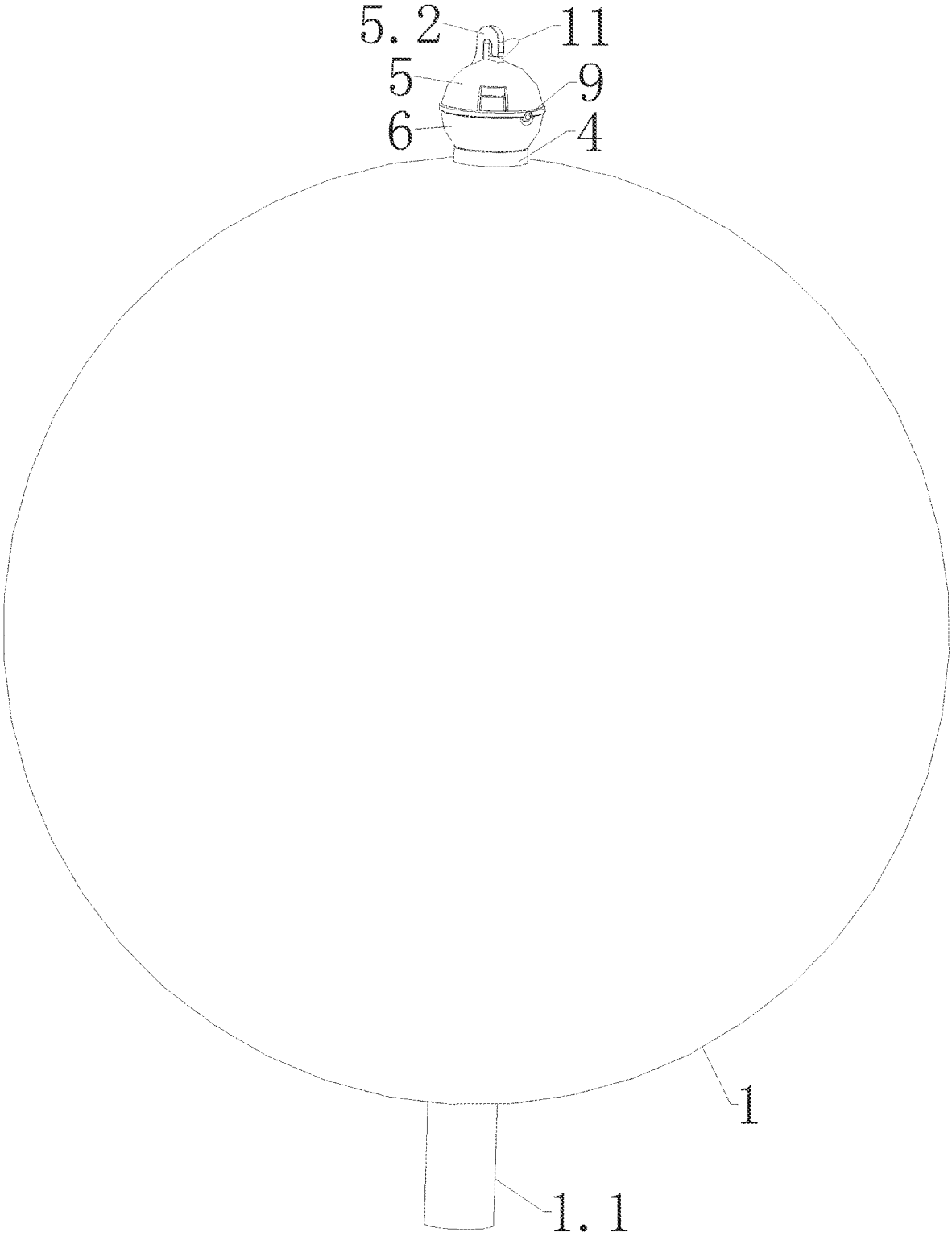
FIG. 1 is a schematic diagram illustrating an entire structure of an embodiment 1 of the present invention.
Figure 2:
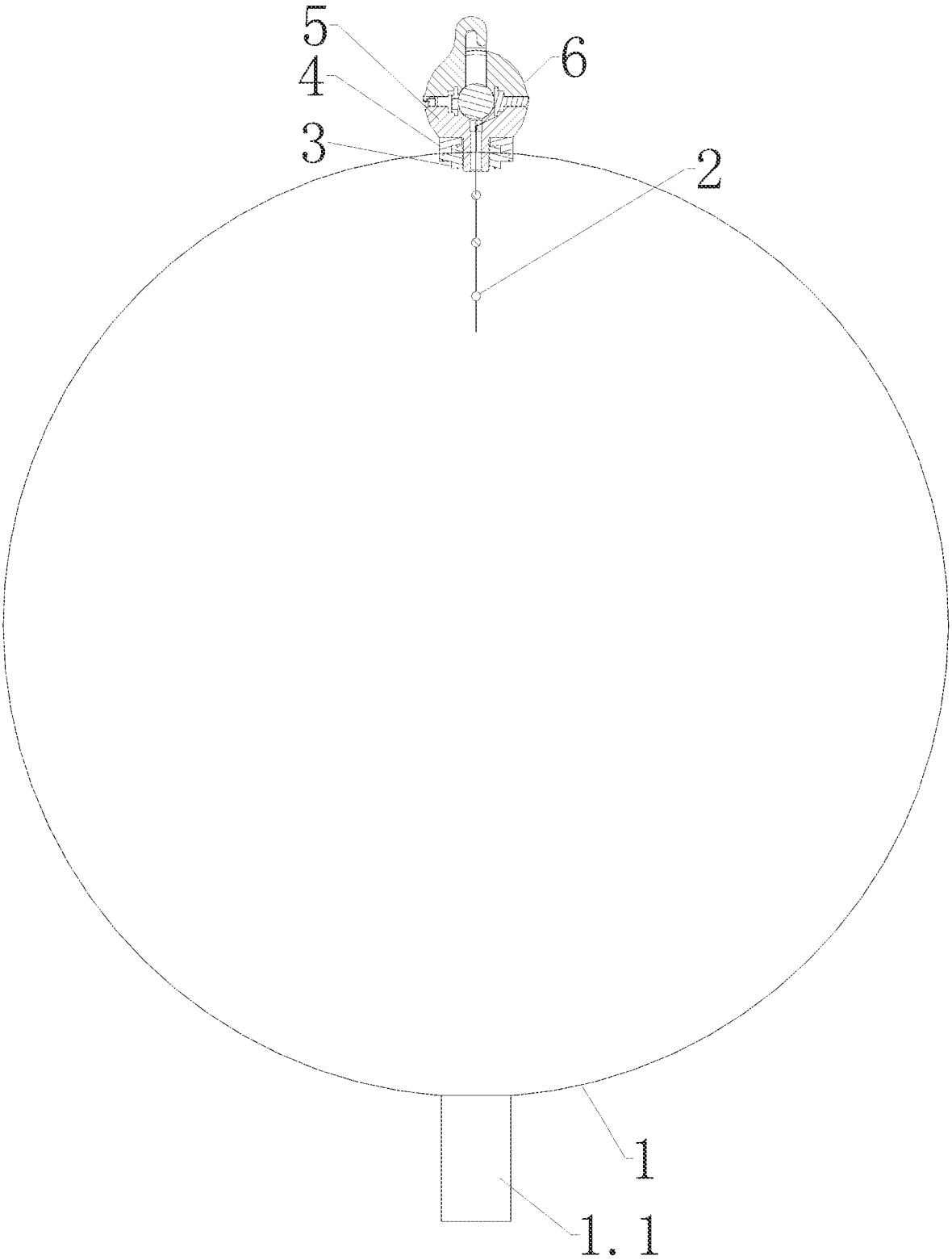
FIG. 2 is a sectional view of an embodiment of the present invention.
Figure 3:
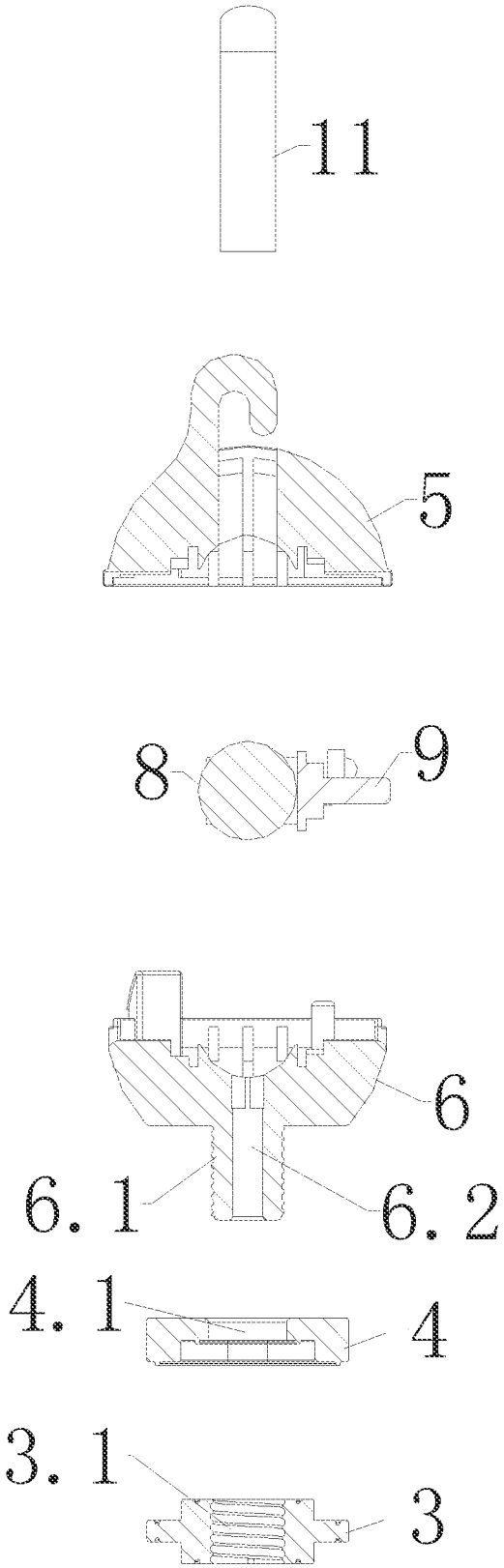
FIG. 3 is an assembly schematic diagram illustrating a connection piece and a light-emitting assembly according to an embodiment 1 of the present invention.

As shown in FIGS. 2 and 3, the connection piece includes a pressing nut 3 and a pressing plug 4, the pressing nut 3 is abutted against an inner wall of the balloon 1, and the pressing plug 4 is pressed on an outer wall of the balloon 1.

As shown in FIGS. 2 and 3, in order to facilitate connection of the controller to the pressing nut 3, the controller includes an upper cover 5 and a lower cover 6, a lower end of the lower cover 6 has a screw rod 6.1 extending up and down, the lower cover 6 is pressed on the top of the pressing plug 4, and the screw rod 6.1 is passed through the pressing plug 4 and then screwed into the pressing nut 3. The lower cover 6 has a first through hole 6.2 penetrating up and down, the pressing plug 4 has a second through hole 4.1 for the screw rod 6.1 to pass through, and the pressing nut 3 has a thread hole 3.1 penetrating up and down and mating with the screw rod 6.1.

Figure 5:
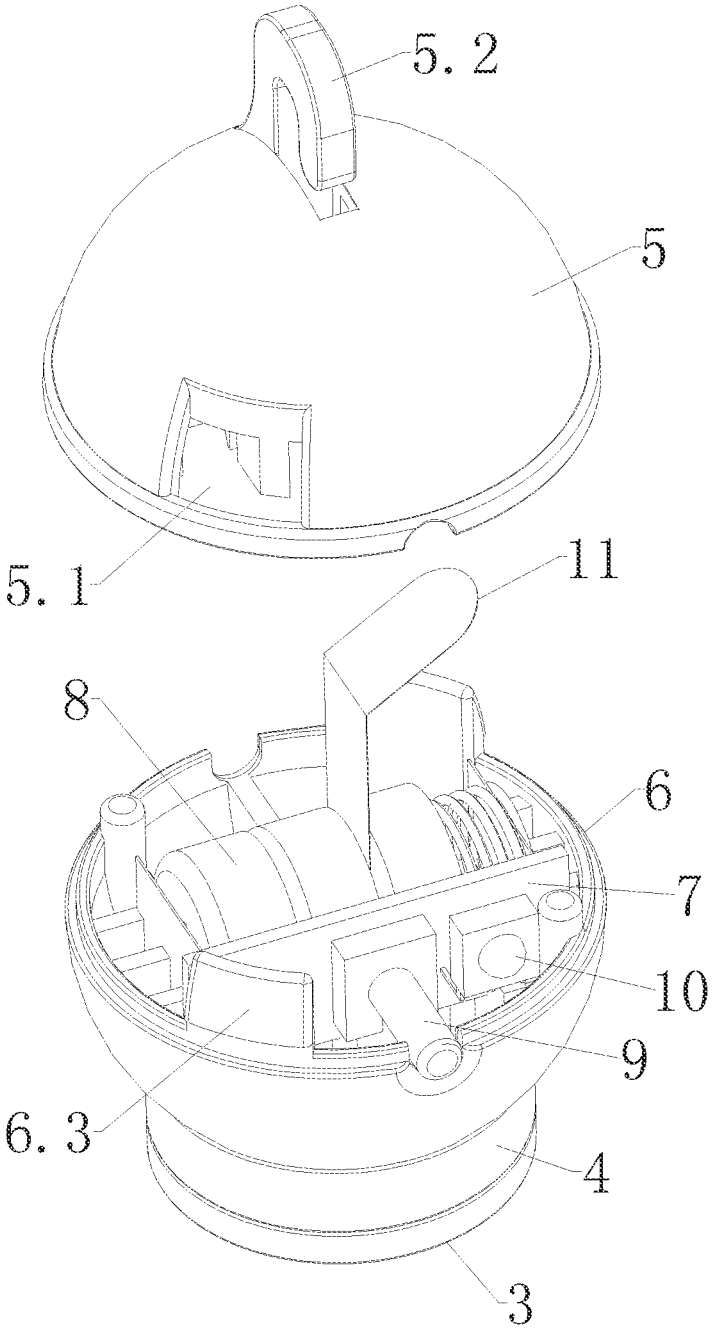
FIG. 5 is an exploded view illustrating a light-emitting assembly according to an embodiment 1 of the present invention.
Figure 6:
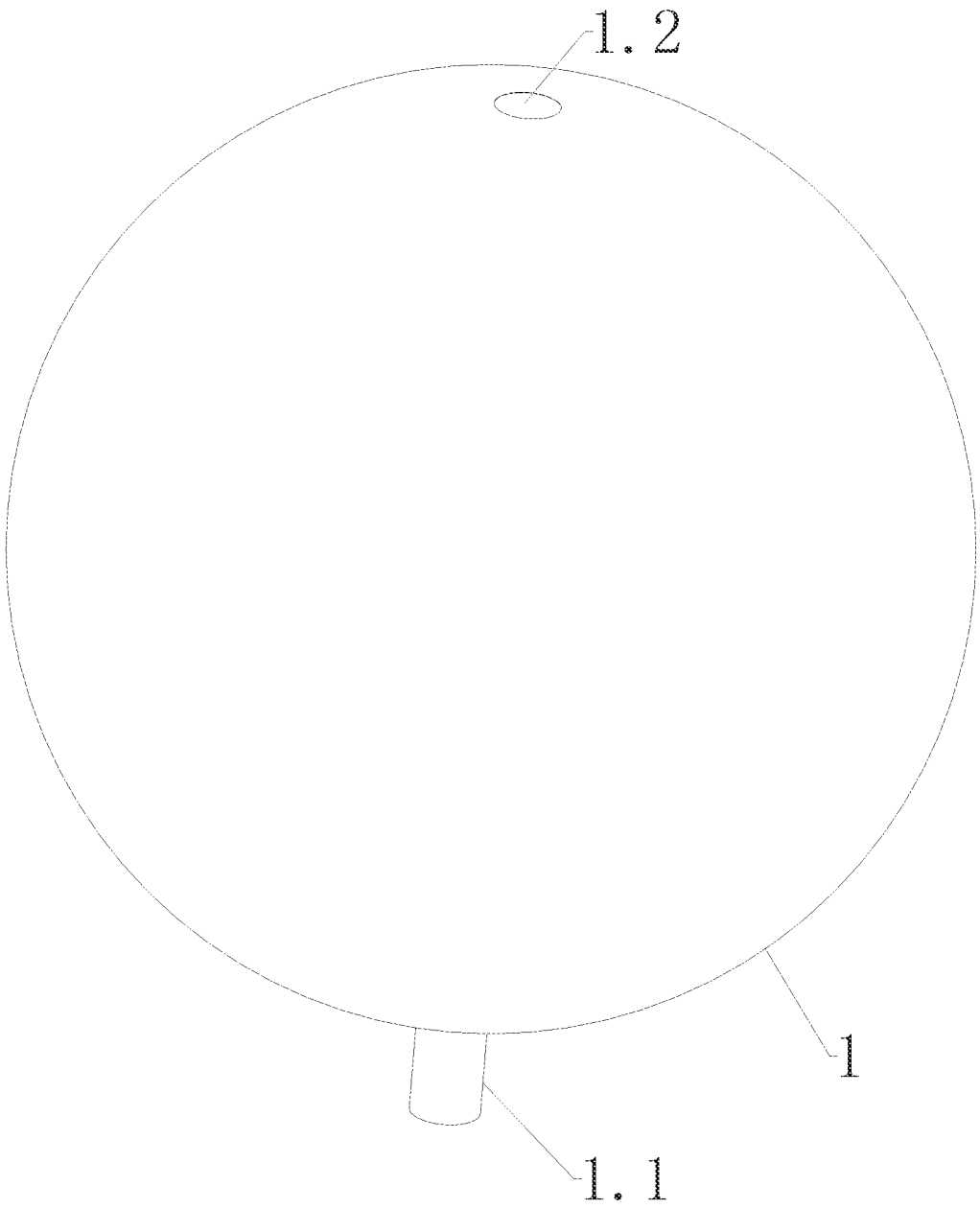
FIG. 6 is a structural schematic diagram illustrating a balloon according to an embodiment 1 of the present invention.

As shown in FIG. 5, the controller further includes a control board 7, a battery 8, a switch 9 and an infrared receiver 10. The control board 7, the battery 8 and the infrared receiver 10 are mounted inside the lower cover 6, and an outer end of the switch 9 extends out of the lower cover 6. During use, the light-emitting lamp 2 may be controlled by pressing the switch 9 and may also be controlled to, for example, be turned on and off, and flash by infrared remote control.

As shown in FIG. 5, there are eight batteries and an insulating sheet 11 is fitted between two batteries 8. An upper end of the insulating sheet 11 extends out of the upper cover 5, and the upper cover 5 has a hole for the insulating sheet 11 to pass through. The insulating sheet 11 may guarantee no electric leakage may occur to the luminous balloon 1 before use and the insulating sheet 11 may be pulled out for use.

Figure 4:
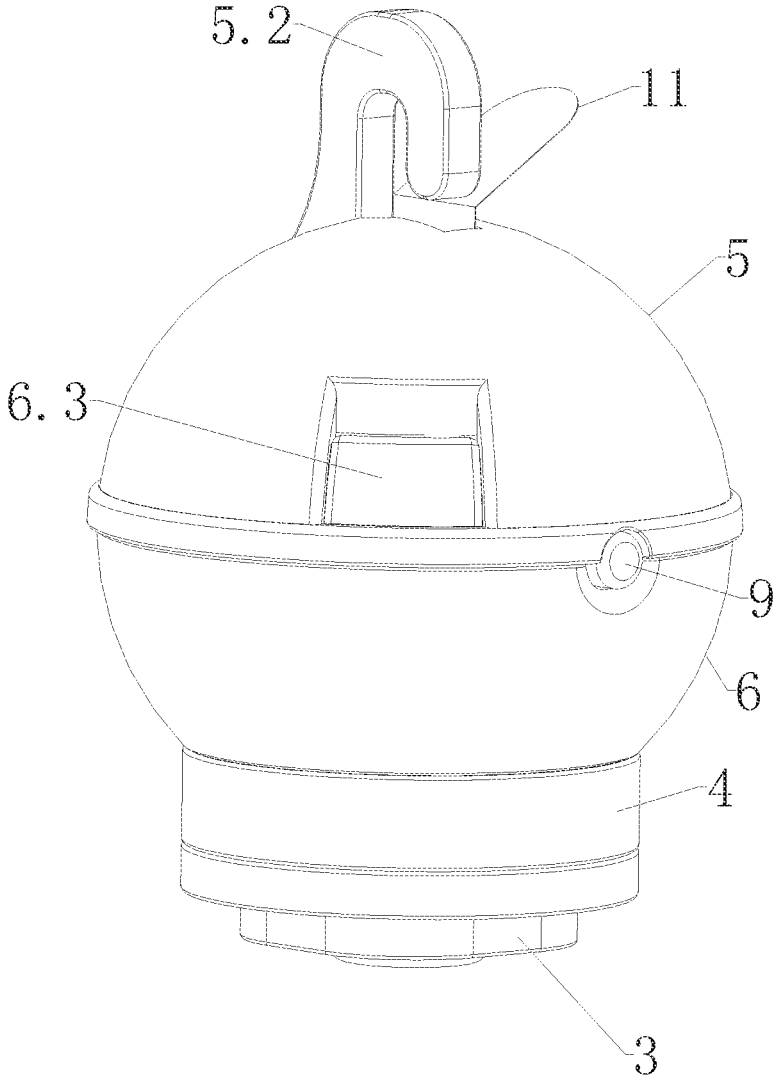
FIG. 4 is a schematic diagram illustrating an entire structure of a connection piece and a light-emitting assembly according to an embodiment 1 of the present invention.

As shown in FIGS. 4 and 5, the upper cover 5 and the lower 6 are connected by a fastener. Two fasteners 6.3 are disposed on an outer edge of an upper end of the lower cover 6 and two fastening holes 5.1 are disposed on an outer edge of a lower end of the upper cover 5. The fastening hole 5.1 is provided for the fastener 6.3 to fit in. After the upper cover 5 is removed, the battery 8 may be replaced conveniently.

As shown in FIG. 4, an upper end of the upper cover 5 has a hook 5.2. With the hook 5.2, the balloon 1 can be conveniently hung.

The luminous balloon provided by the present invention has the independent inflation opening 1.1, and the controller exposed outside the balloon 1 controls the light-emitting lamp 2, and the light-emitting lamp 2 protrudes into the balloon 1 to illuminate the entire balloon 1, thus achieving a desirable decorative effect.

The light-emitting lamp 2 may be one or more lamp beads which are mounted on a lamp wire 13. When the lamp wire 13 is placed into the irregularly-shaped balloon 1, the irregularly-shaped balloon 1 will be entirely illuminated.

Figure 7:
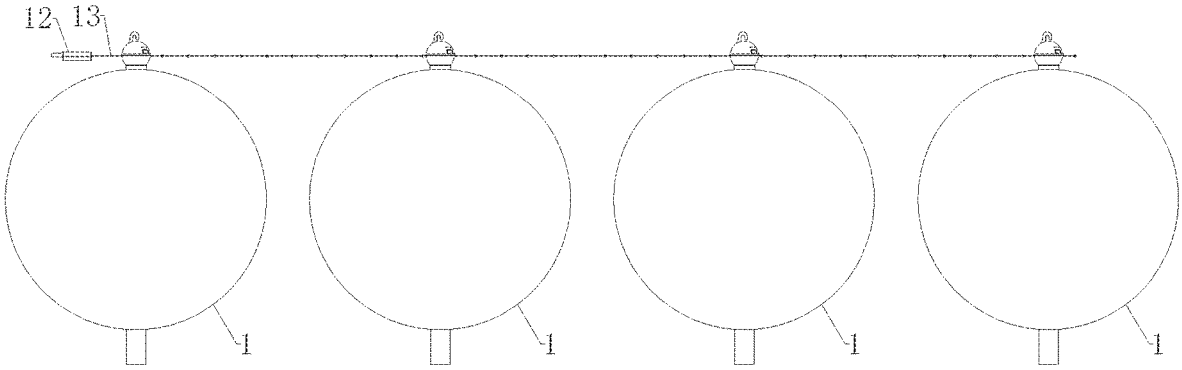
FIG. 7 is a schematic diagram illustrating an entire structure of an embodiment 2 of the present invention.
Figure 8:
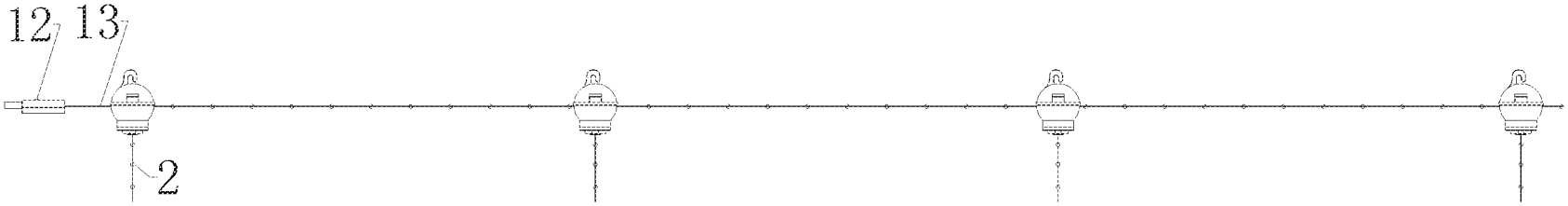
FIG. 8 is a schematic diagram illustrating a structure without a balloon according to an embodiment 2 of the present invention.

In an embodiment 2, the embodiment 1 differs from the embodiment 2 in that, as shown in FIGS. 7 and 8, the controller may further include a USB connector 12 which is connected to the light-emitting lamp 2 through the lamp wire 13, and the USB connector 12 may be connected to a power adaptor, or a power bank or a batter box. The lamp wire 13 is protruded into the upper cover 5 and the lower cover 6, and then passed through the pressing plug 4 and the pressing nut 3. In use, a plurality of balloons 1 may be used together.

Of course, the above descriptions are merely made to the preferred embodiments of the present invention, but do not limit the scope of protection of the present invention. Any simple modifications or equivalent structural changes made based on the descriptions and the accompanying drawings shall fall within the scope of protection of the present invention.

What is claimed is:

1. A luminous balloon, comprising a balloon (1), wherein the luminous balloon further comprises a connection piece and a light-emitting assembly, the balloon (1) has an inflation opening (1.1) and a connection opening (1.2), the connection piece is fixed at the connection opening (1.2) and connected with the light-emitting assembly, the light-emitting assembly comprises a controller and a light-emitting lamp (2), the controller is exposed outside the balloon (1), and the light-emitting lamp (2) passes through the connection piece to wholly or partially protrude into the balloon (1).

2. The luminous balloon of claim 1, wherein the inflation opening (1.1) and the connection opening (1.2) are located on a bottom end and a top end of the balloon (1) respectively.

3. The luminous balloon of claim 1, wherein the connection piece comprises a pressing nut (3) and a pressing plug (4), the pressing nut (3) is abutted against an inner wall of the balloon (1), and the pressing plug (4) is pressed on an outer wall of the balloon (1).

4. The luminous balloon of claim 3, wherein the controller comprises an upper cover (5) and a lower cover (6), a lower end of the lower cover (6) has a screw rod (6.1) extending up and down, the lower cover (6) is pressed on the top of the pressing plug (4), and the screw rod (6.1) is passed through the pressing plug (4) and then screwed down into the pressing nut (3).

5. The luminous balloon of claim 4, wherein the lower cover (6) has a first through hole (6.2) penetrating up and down, the pressing plug (4) has a second through hole (4.1) for the screw rod (6.1) to pass through, and the pressing nut (3) has a thread hole (3.1) penetrating up and down and mating with the screw rod (6.1).

6. The luminous balloon of claim 4, wherein the controller further comprises a control board (7), a battery (8), a switch (9) and an infrared receiver (10), the control board (7), the battery (8) and the infrared receiver (10) are mounted inside the lower cover (6), and an outer end of the switch (9) extends out of the lower cover (6).

7. The luminous balloon of claim 6, wherein there are a plurality of batteries, an insulating sheet (11) is fitted between two batteries (8) and an upper end of the insulating sheet (11) extends out of the upper cover (5).

8. The luminous balloon of claim 4, wherein the upper cover (5) and the lower (6) are connected by a fastener.

9. The luminous balloon of claim 4, wherein an upper end of the upper cover (5) has a hook (5.2).

10. The luminous balloon of claim 4, wherein the controller further comprises a USB connector (12) which is connected to the light-emitting lamp (2) through a lamp wire (13).

* * * * *